US007178462B2

(12) United States Patent
Beasley

(10) Patent No.: US 7,178,462 B2
(45) Date of Patent: Feb. 20, 2007

(54) PROJECTILE WITH MEMBERS THAT DEPLOY UPON IMPACT

(76) Inventor: Joseph S. Beasley, R.R. 1 Box 142A, Summerville, MO (US) 65571

( * ) Notice: Subject to any disclaimer, the term of this patent is extended or adjusted under 35 U.S.C. 154(b) by 224 days.

(21) Appl. No.: 10/813,971

(22) Filed: Mar. 31, 2004

(65) Prior Publication Data

US 2005/0217528 A1 Oct. 6, 2005

(51) Int. Cl.
*F42B 30/00* (2006.01)
*F42B 12/34* (2006.01)

(52) U.S. Cl. ..... 102/400; 102/501

(58) Field of Classification Search ..... 102/501, 102/502, 506, 507–510, 512, 514, 400
See application file for complete search history.

(56) References Cited

U.S. PATENT DOCUMENTS

| | | | | | |
|---|---|---|---|---|---|
| 103,514 | A | * | 5/1870 | Shock | 244/3.1 |
| 275,258 | A | * | 4/1883 | Palliser | 102/519 |
| 854,923 | A | | 5/1907 | Broad | |
| 948,148 | A | * | 2/1910 | Schenk | 102/508 |
| 1,095,502 | A | * | 5/1914 | Hoagland | 102/507 |
| 1,096,558 | A | * | 5/1914 | Newton | 102/508 |
| 1,099,298 | A | * | 6/1914 | Garber | 102/507 |
| 1,101,743 | A | * | 6/1914 | Hoagland | 102/508 |
| 1,134,797 | A | | 4/1915 | Wood | |
| 1,318,858 | A | | 10/1919 | Frick | |
| 1,328,334 | A | * | 1/1920 | Newton | 102/508 |
| 1,398,229 | A | * | 11/1921 | Hadfield et al. | 102/519 |
| 1,402,776 | A | * | 1/1922 | Lefevre | 102/519 |
| 1,464,032 | A | | 8/1923 | Daynix | |
| 1,493,614 | A | * | 5/1924 | Dickerman | 102/510 |
| 2,246,429 | A | * | 6/1941 | Brandt | 102/519 |
| 2,247,111 | A | * | 6/1941 | Batchelor et al. | 102/501 |
| 2,342,006 | A | * | 2/1944 | Moore | 102/519 |
| 2,482,132 | A | * | 9/1949 | Studler et al. | 102/439 |
| 2,617,359 | A | * | 11/1952 | Horn et al. | 102/512 |
| 2,661,694 | A | * | 12/1953 | Allen et al. | 102/508 |
| 2,922,366 | A | * | 1/1960 | Lyon | 102/398 |
| 2,987,999 | A | * | 6/1961 | Robinson, Jr. et al. | 102/501 |
| 3,080,817 | A | * | 3/1963 | Robinson, Jr. et al. | 102/501 |
| 3,143,966 | A | * | 8/1964 | Burns, Jr. et al. | 102/507 |
| 3,157,137 | A | * | 11/1964 | Burns, Jr. | 102/509 |
| 3,344,711 | A | * | 10/1967 | Mawhinney et al. | 89/14.05 |
| 3,348,486 | A | * | 10/1967 | Rapp | 102/507 |
| 3,386,381 | A | * | 6/1968 | Ferb | 102/512 |
| 3,396,660 | A | * | 8/1968 | Bilson et al. | 102/512 |
| 3,502,025 | A | * | 3/1970 | Payne | 102/512 |
| 3,565,435 | A | * | 2/1971 | Bear | 473/581 |

(Continued)

*Primary Examiner*—James S. Bergin
(74) *Attorney, Agent, or Firm*—Martin & Associates, LLC; Derek P. Martin

(57) ABSTRACT

A projectile includes members that deploy upon impact with a target. The projectile includes a nose piece with a portion that shears off upon impact with the target, causing the nose piece to be pushed inside the projectile. As the nose piece is pushed inside the projectile, the nose piece pushes on members that deploy outwardly and lock into place, thereby greatly increasing the damage done to the target. The projectile is easily assembled by placing the two members through an axial cylindrical hole into slots, then placing the nose piece into the axial cylindrical hole. The deployable members are held within the body of the projectile in flight, and only deploy when the projectile strikes a target, greatly increasing the damage to the target.

18 Claims, 4 Drawing Sheets

U.S. PATENT DOCUMENTS

| | | | | | |
|---|---|---|---|---|---|
| 3,584,582 | A | * | 6/1971 | Muller | 102/512 |
| 3,769,911 | A | * | 11/1973 | Folkins | 102/397 |
| 3,952,662 | A | | 4/1976 | Greenlees | 102/92.7 |
| 4,008,667 | A | | 2/1977 | Look | 102/88 |
| 4,136,616 | A | | 1/1979 | Schirneker | 102/38 |
| 4,665,827 | A | | 5/1987 | Ellis, II | 102/510 |
| 4,685,397 | A | | 8/1987 | Schirneker | 102/510 |
| 4,723,087 | A | * | 2/1988 | Fox et al. | 310/329 |
| 4,776,279 | A | * | 10/1988 | Pejsa | 102/510 |
| 5,097,768 | A | * | 3/1992 | Petrovich | 102/510 |
| 5,191,168 | A | * | 3/1993 | Puckett | 102/457 |
| 5,221,809 | A | | 6/1993 | Cuadros | 102/439 |
| 5,515,787 | A | * | 5/1996 | Middleton | 102/503 |
| 6,174,252 | B1 | * | 1/2001 | Mizek | 473/583 |
| 6,217,467 | B1 | | 4/2001 | Maleski | 473/583 |
| 6,240,849 | B1 | | 6/2001 | Holler | 102/439 |
| 6,270,435 | B1 | | 8/2001 | Sadaro | 473/583 |
| 6,526,893 | B2 | * | 3/2003 | May et al. | 102/508 |
| 6,598,536 | B2 | * | 7/2003 | Burri | 102/522 |
| 6,796,244 | B2 | * | 9/2004 | Loubser | 102/473 |
| 6,807,908 | B2 | * | 10/2004 | Brydges-Price | 102/512 |
| 6,880,466 | B2 | * | 4/2005 | Carman | 102/502 |
| 2004/0089186 | A1 | * | 5/2004 | Brygdes-Price | 102/502 |
| 2005/0039628 | A1 | * | 2/2005 | Carman | 102/502 |
| 2005/0217528 | A1 | * | 10/2005 | Beasley | 102/510 |

* cited by examiner

PROJECTILE WITH MEMBERS THAT DEPLOY UPON IMPACT

BACKGROUND OF THE INVENTION

1. Technical Field

This invention generally relates to the field of projectiles, and more specifically relates to projectiles with deployable members.

2. Background Art

Many advances have been made in the art of projectiles, such as bullets fired from guns. Several known bullets are made of lead or other soft material that expands (known as "mushrooming") when the bullet hits. The expansion of a lead bullet inside a target causes a greater knock-down effect, and increases the damage done to bones and internal organs, but typically slows the bullet to the point that it does not exit the target. In hunting applications, it is desirable for the bullet to exit the animal so the animal bleeds from the exit would, allowing the hunter to track the animal from the trail of blood. One way to assure the bullet exits the animal is to use a harder material that does not expand upon impact. The drawback of this approach is the damage done to the animal is not as great as for a softer, expanding bullet, increasing the likelihood of survival for an animal shot with a hard bullet. In addition, because a hard bullet does not expand, the animal will not likely bleed a great deal because the exit would is small, the same diameter of the bullet.

Some projectiles have been developed with members that deploy to increase the damage when the projectile hits its target. For example, U.S. Pat. No. 6,240,849 to Holler and U.S. Pat. No. 1,464,032 to Daynix disclose projectiles that have members that deploy in-flight. These members increase the damage to the target upon impact. U.S. Pat. No. 1,318,858 to Frick discloses a projectile that may expand in-flight, or that may expand upon impact with a target. The Frick projectile includes pivoting knife arms that extend to create more damage to the target. The configuration of the Frick projectile is quite complex, and would be very difficult to manufacture in a cost-effective manner. What is needed is a projectile that provides members that deploy upon impact with a target that may be manufactured and assembled in a cost-effective manner.

DISCLOSURE OF INVENTION

According to the preferred embodiments, a projectile includes members that deploy upon impact with a target. The projectile includes a nose piece with a portion that shears off upon impact with the target, causing the nose piece to be pushed inside the projectile. As the nose piece is pushed inside the projectile, the nose piece pushes on members that deploy outwardly and lock into place, thereby greatly increasing the damage done to the target. The body portion of the projectile is preferably made of a hardened metal such as bronze that will not significantly deform when it hits an animal. The nose piece is preferably made of plastic, while the deployable members are preferably made of hardened steel. The projectile is easily assembled by placing the two members through an axial cylindrical hole into slots, then placing the nose piece in the axial cylindrical hole. The deployable members are held within the body of the projectile in flight, and only deploy when the projectile strikes a target by shearing off a portion of the nose piece, thereby forcing the nose piece inside the projectile, which causes the members to move to their deployed position.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and.

BEST MODE FOR CARRYING OUT THE INVENTION

Figure 1:
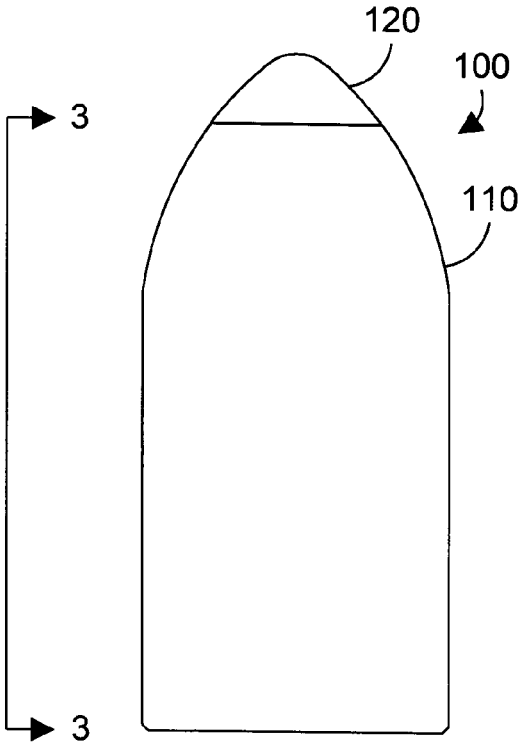
FIG. 1 is a top view of a projectile in accordance with a first embodiment.

Referring now to FIG. 1, a bullet 100 is one suitable configuration for a projectile in accordance with a first embodiment. Bullet 100 could be used in muzzle loading firearms, or could be part of a cartridge. Bullet 100 includes a body 110 and a nose piece 120. The body 110 is made of a suitable hard material that does not substantially deform when striking an animal's body. In the most preferred implementation, the body 110 is made of bronze. Nose piece 120 is made of a material that is soft enough to allow a portion of the nose piece to shear off when the bullet 100 strikes a target. In the most preferred implementation, the nose piece 120 is made of plastic, such as Delrin manufactured by DuPont.

Figure 2:
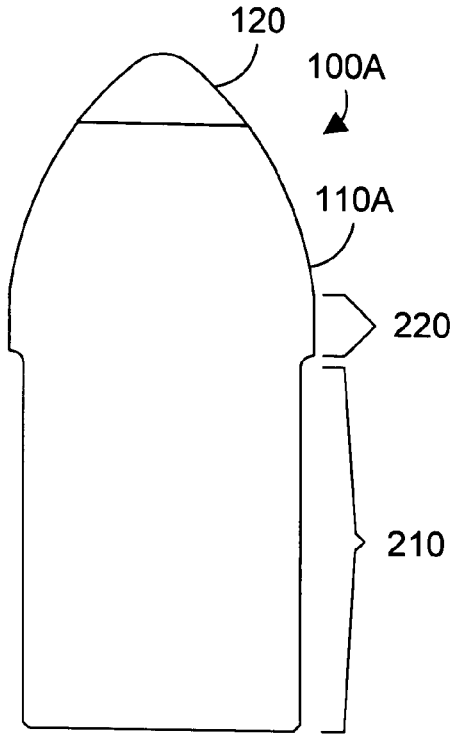
FIG. 2 is a top view of a projectile in accordance with a second embodiment.

FIG. 2 shows an alternative configuration of a bullet 100A in accordance with a second embodiment. The bullet 100A includes the same nose piece 120 used in bullet 100 in FIG. 1. However, the body 110A for bullet 100A is different than the body 110 for bullet 100 in FIG. 1. Note that body 110 includes a reduced diameter portion 210 and a full diameter portion 220. The reduced diameter portion 210 allows a sabot, which is well-known in the art of muzzle loading, to be used with the bullet 100A. Note, however, that the full-diameter portion 220 means that the bullet 100A is still a full-bore bullet. No other bullets are known that are full-bore and yet still allow the use of a sabot.

The remaining figures show the details of bullet 100 in FIG. 1 in accordance with the first embodiment. It will be appreciated, however, that the same internal structure and configuration is preferably provided in bullet 100A in accordance with the second embodiment.

Figure 3:
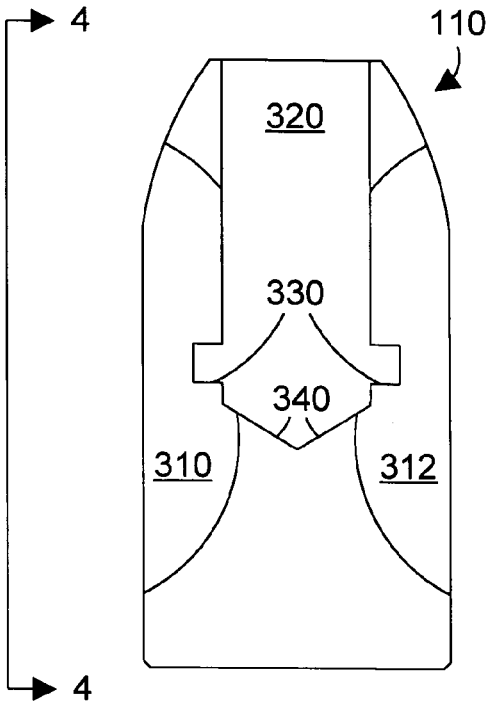
FIG. 3 is a cross-sectional view of the projectile in FIG. 1 taken along the line 3—3.
Figure 4:
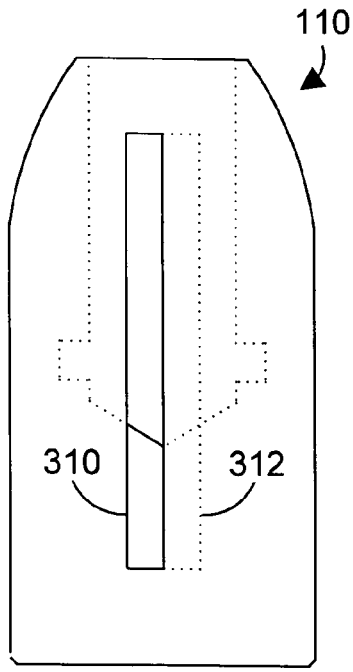
FIG. 4 is a side view of the projectile in FIG. 1 taken along the line 3—3.

FIG. 3 shows a cross-sectional view of the body 110 of the bullet 100 in FIG. 1 taken along line 3—3. The body 110 includes an axial cylindrical hole 320 that is preferably drilled in the center of the body 110. Note that cylindrical hole 320 preferably includes a cylindrical groove 330 near its bottom, and includes a v-shaped bottom 340. The angle of the v-shaped bottom 340 is preferably determined by the angle of a drill bit used to drill out the cylindrical hole 320. Body 110 also includes two slots 310 and 312 that create openings between the side surfaces of the body 110 and the cylindrical hole 320. Note that slots 310 and 312 are preferably offset by the width of a slot, as shown in FIG. 4. This offset configuration allows each slot to receive a corresponding knife member, shown in FIG. 5, without the knife members interfering with each other.

Figure 5:
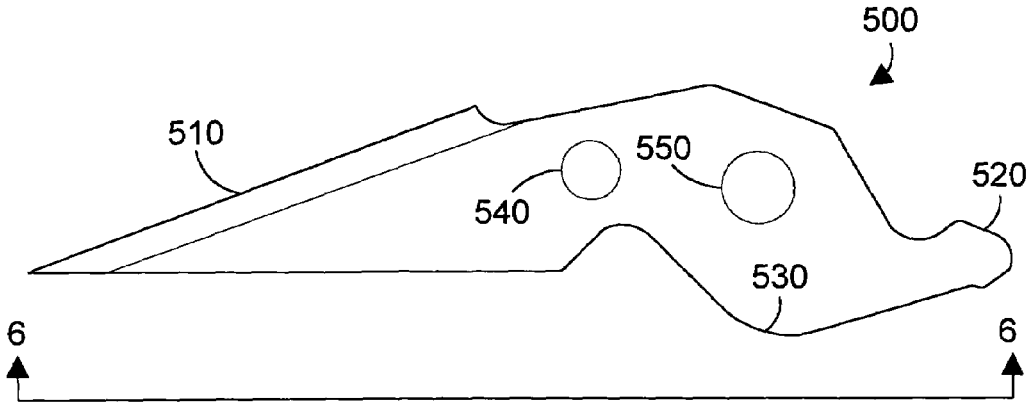
FIG. 5 is an enlarged top view of a knife member in accordance with the preferred embodiments.

Referring to FIG. 5, each deployable knife member 500 is preferably made of hardened steel. Knife member 500 includes a sharpened edge 510, a tab 520, a v-shaped portion 530, a first raised member 540, and a second raised member 550. Knife member 500 has a thickness profile shown in FIG. 6. The first and second raised members 540 and 550 provide a desired function of the projectile 100. The first raised member 540 does not allow the knife member 500 to deploy in-flight, because the thickness of the first raised member 540 added to the thickness 610 of the main body of knife member 500 is slightly greater than the thickness of the slots 310 and 312. However, once the nose piece is forced into the body portion due to the force of impact on the target, the force of the nose piece pushing on the knife member is sufficient to overcome the slight difference in height, forcing the first raised member 540 into the slot. Note, however, that the second raised portion 550 is substantially higher than the first raised portion 540. The second raised portion 550 serves to assure that a portion of the knife member 500 stays inside the bullet 100. Thus, when the bullet is in flight, the first raised member 540 keeps the knife member 500 in its retracted position. Once the bullet hits the target, the force of the nose piece is sufficient to force the first raised member 540 into the slot, while the second raised member 550 is retained within the axial cylindrical hole 320. In this manner the knife members 500 may be easily deployed upon impact with a target without the risk of the knife members 500 pulling out of the body 110.

Figure 7:
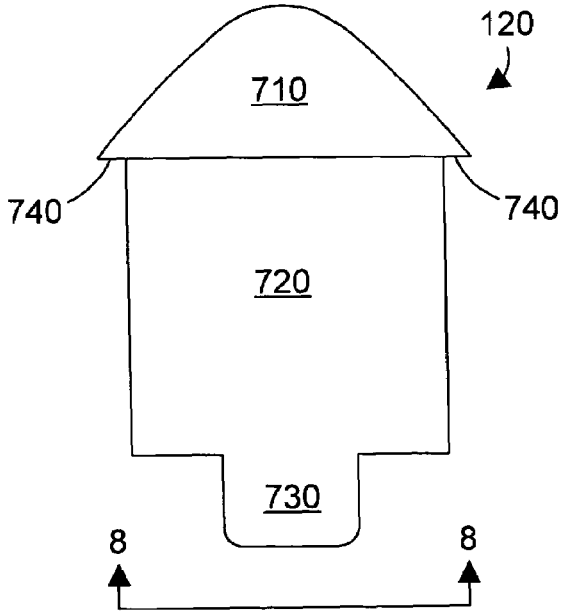
FIG. 7 is a side view of a nose piece in accordance with the preferred embodiments.
Figure 8:
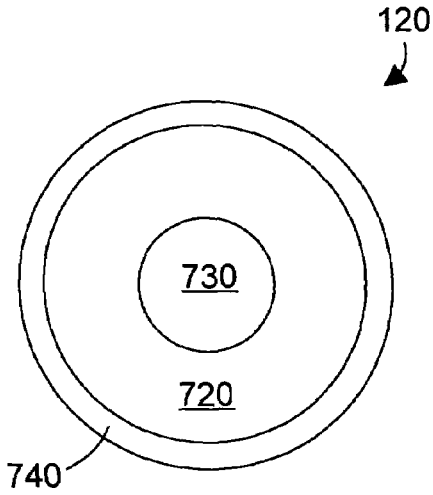
FIG. 8 is a bottom view of the nose piece in FIG. 7 taken along the line 8—8.

Referring to FIGS. 7 and 8, a nose piece 120 in accordance with the preferred embodiments is shown. Nose piece 120 includes a conical upper portion 710, a cylindrical body portion 720, and a reduced diameter portion 730. The diameter of cylindrical portion 720 is selected to provide a friction-fit of the nose piece 120 within the axial cylindrical hole 320 in FIG. 3. Note that the conical upper portion 710 includes a flange portion 740 that has a diameter greater than the cylindrical portion 720. This flange portion 740 is a shear member that is preferably sheared off when the bullet 100 strikes a target. This shearing function is described in more detail below.

Figure 9:
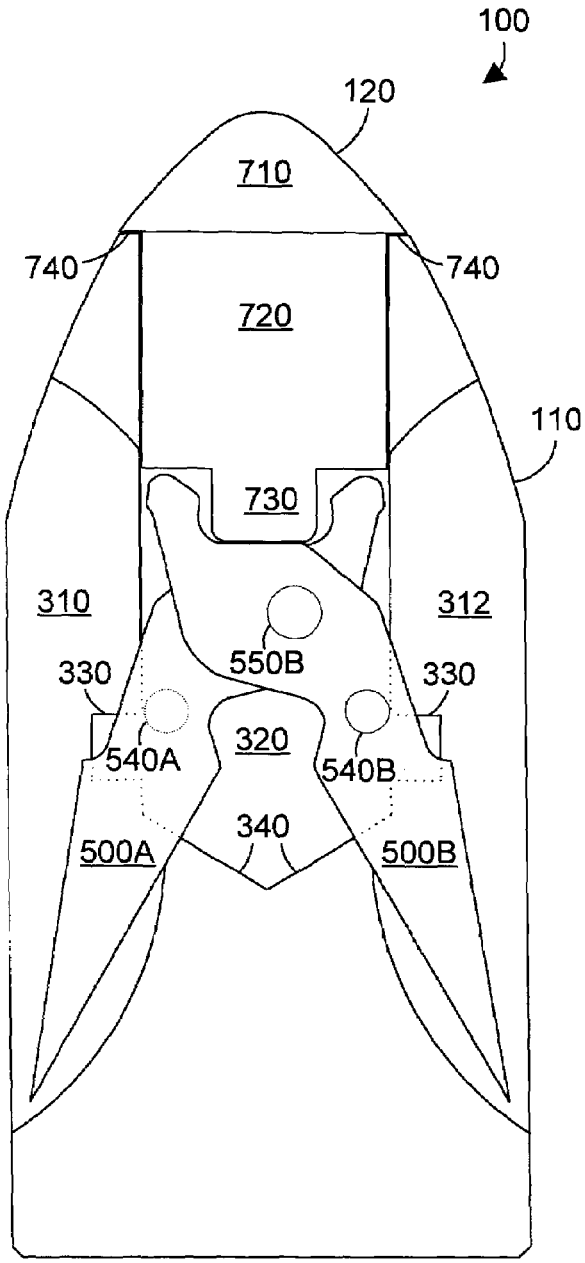
FIG. 9 is a cross-sectional view of the projectile in FIG. 1 taken along the line 3—3 with the knife members and nose piece installed.
Figure 10:
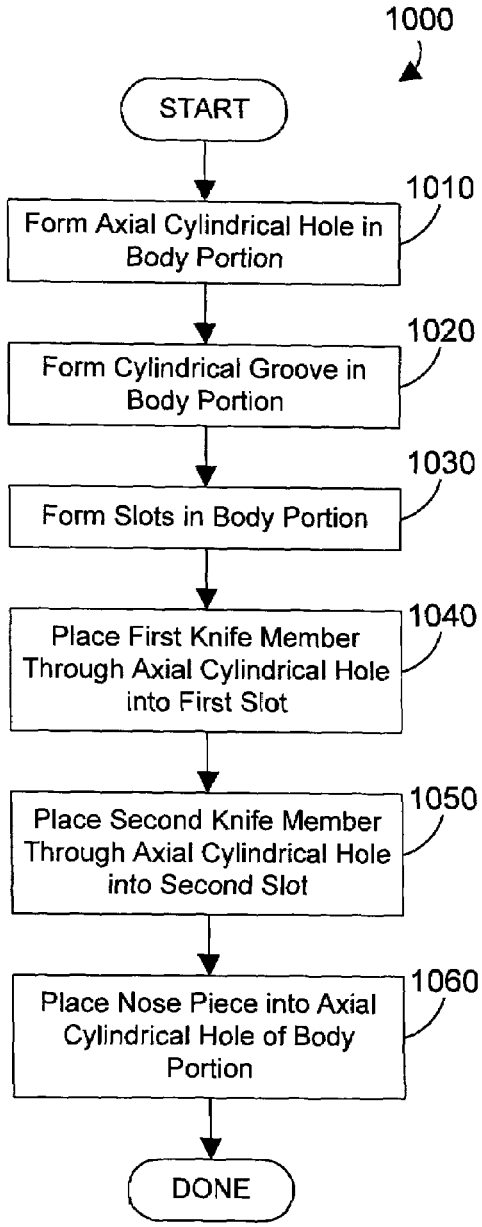
FIG. 10 is a flow diagram of a method for manufacturing a projectile with deployable members in accordance with the preferred embodiments.

Referring now to FIG. 9, bullet 100 is shown in a partial cross-sectional view that shows the nose piece 120 and the two knife members 500A and 500B. Note that knife members 500A and 500B are preferably identical, and preferably have the configuration shown in FIG. 5. The bullet 100 may be easily assembled using method 1000 shown in FIG. 10. We start with a body 110. First, we form an axial cylindrical hole 320 in the body 110 (step 1010). In the specific example shown in the figures, the axial cylindrical hole 320 is formed by drilling. Next, the cylindrical groove 330 is formed near the bottom of the hole 320 (step 1020). The slots 310 and 312 are then formed in the body 110 (step 1030). At this point the body 110 is ready for assembly. The first knife member 500A is placed through the axial cylindrical hole 320 into the first slot 310 (step 1040). The second knife member 500B is then placed through the axial cylindrical hole 320 into the first slot 310 (step 1050). Note that knife members 500A and 500B are preferably identical members installed back-to-back, which positions the first and second raised members 540 and 550 on the opposite side of the contact area between the two knife members 500A and 500B, allowing the two knife members 500A and 500B to move with respect to each other without interference. With both knife members 500A and 500B in place, the assembly is completed by pushing the nose piece 120 into the axial cylindrical hole 320 (step 1060). Nose piece 120 has a friction-fit with the hole 320 by having a diameter the same or just slightly larger than the hole 320. Note that the reduced diameter portion 730 of the nose piece 120 comes into contact with the knife members 500A and 500B, as shown in FIG. 9. The first raised portions 540A and 540B of the knife members keep the knife members in their retracted positions.

Figure 11:
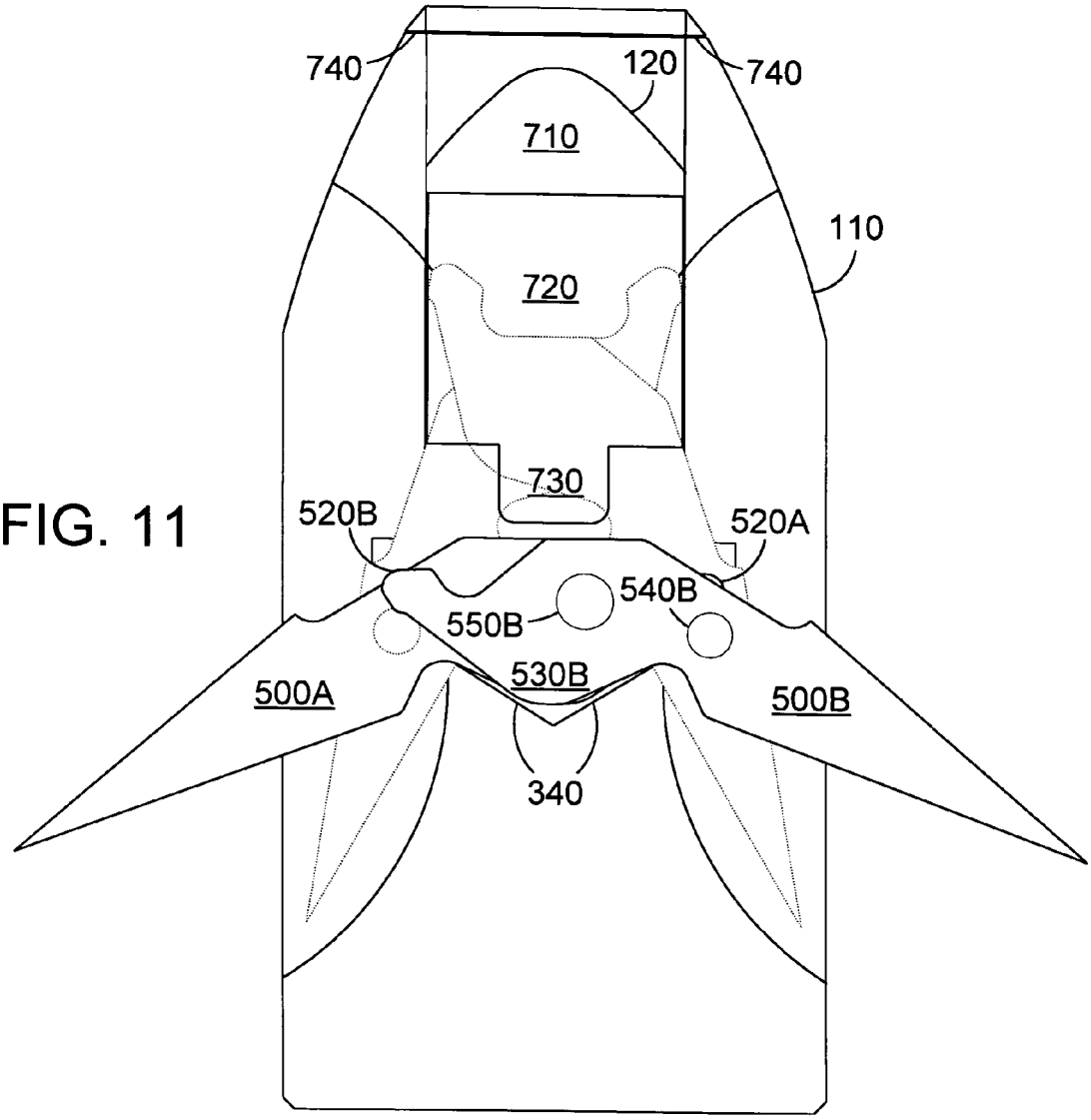
FIG. 11 is a cross-sectional view of the projectile in FIG. 9 showing the shearing off of a portion of the nose piece and the resulting deployment of the knife members when the projectile hits a target.

The deployment of the knife members when the bullet strikes a target is shown in FIG. 11. First, the force of the bullet impacting the target shears off the extended portion 740 of the nose piece as the nose piece 120 is pushed farther into the body 110, as shown in FIG. 11. As the nose piece 120 is pushed into the body 110, it pushes the knife members 500A and 500B from their retracted positions, shown in phantom in FIG. 11, to their deployed positions shown in FIG. 11. As the nose piece 120 pushes on the knife members 500A and 500B, the first raised members 540A and 540B are forced into the slots, thereby extending the sharpened blade portions outside of the body 110 to their deployed position. In addition, the movement of the knife members causes the knife members to pivot so their tabs 520A and 520B snap into the cylindrical groove 330, thereby locking the knife members 500A and 500B in place in the deployed position. In addition, the v-shaped portions 530A and 530B align with the v-shaped bottom 340 of the axial cylindrical hole 320, helping to keep the knife members 500A and 500B in their deployed position.

The nose piece 120 in FIG. 11 acts like a plunger to force the two knife members 500A and 500B to a deployed position. Once deployed, there are several things that keep the knife members in the deployed position. First, the nose piece 120 has been jammed into the body portion, shearing off the annular ring 1210 shown in FIG. 12. The result is a very tight fit that helps the nose piece 120 to keep the knife members 500A and 500B in their deployed position by maintaining the position of the reduced diameter portion 730 relative to the two knife members 500A and 500B. In addition, the tabs 520A and 520B engage the cylindrical groove 330 (shown more clearly in FIG. 9), thereby preventing the knife members from moving back to their retracted position. The v-shaped portions 530A and 530B also align with the v-shaped bottom 340 of the axial cylindrical hole. Finally, the second raised members (e.g., 550B in FIG. 11) keep the knife members 500A and 500B from pulling out from the body 110.

Figure 12:
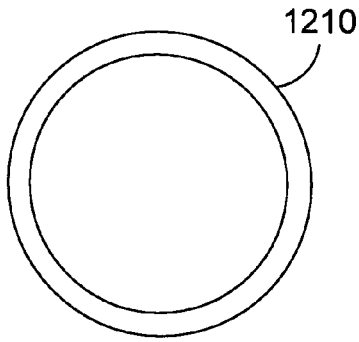
FIG. 12 is a top view of the annular ring of the nose piece that is sheared off when the projectile hits a target.

FIG. 12 illustrates an annular ring 1210 that is sheared off of the nose portion 120 when the bullet 100 strikes its target. Note that the annular ring 1210 is simply one example of a suitable shear portion on the nose piece 120. The preferred embodiments extend to any shape and configuration of one or more shear portions on the nose piece 120 that keep the nose piece 120 in a first position when the projectile is being loaded and fired, and that shears off to move the nose piece 120 farther inside of the body 110 when the bullet 100 hits its target.

Preferred Dimensions

Preferred dimensions are now provided for a 45 caliber (11.4 mm) 230 grain (14.9 gram) bullet in accordance with the preferred embodiments. These dimensions are given by way of example, and are not limiting of the claims herein.

The height of the body 110 is 0.89 inch (22.6 mm). The diameter of the body 110 is 0.451 inch (11.5 mm). The diameter of the axial cylindrical hole 320 is 0.218 inch (5.54 mm). The height of the cylindrical groove 330 is 0.059 inch (1.50 mm). The depth of the cylindrical groove 330 is 0.043 inch (1.09 mm). The depth of the axial cylindrical hole 320 to the beginning of the v-shaped bottom 340 is 0.502 inch (12.75 mm). The depth of the v-shaped bottom 340 is 0.066 inch (1.68 mm). Each slot 310 and 312 is 0.052 inches (1.32 mm) wide, and 0.659 inch (16.74 mm) in height at the exterior surface of the body 110.

Figure 6:
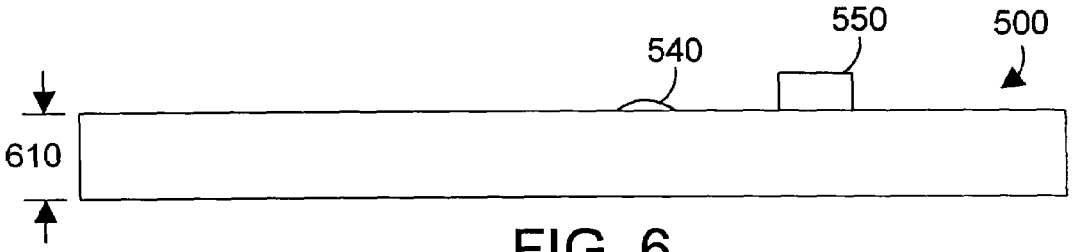
FIG. 6 is side view of the knife member in FIG. 5 taken along the line 6—6.

The thickness 610 of the main portion of the knife member 500 is 0.050 inch (1.27 mm). The first raised member 540 is a dimple that has a height of 0.005 inches (0.127 mm) to 0.008 inches (0.203 mm) above the surface of the knife member 500, as shown in FIG. 6. The second raised member 550 has a height of 0.020 inches (0.508 mm) above the surface of the knife member 500. The knife member 500 has an overall length of 0.631 inch (16.03 mm), and has an overall width of 0.160 inch (4.06 mm).

The overall height of the nose piece 120 is 0.368 inch (9.35 mm). The height of the reduced diameter portion 730 is 0.305 inch (7.75 mm). The height of the body portion 720 is 0.201 inch (5.11 mm). The diameter of the reduced diameter portion 730 is 0.092 inch (2.34 mm). The diameter of the body portion 720 is 0.218 inch (5.54 mm). The diameter of flange portion 740 is 0.250 inch (6.35 mm). This means that the width of the annular shear ring 1210 is 0.032 inch (0.81 mm).

The combination of features shown herein results in a projectile that is relatively easy to manufacture and assemble and a reasonable cost. There are no pivot pins, set screws, or other things that are mechanically complex and prone to failure. The projectile of the present invention provides a bullet that will penetrate clear through a target, yet cause enough damage to more likely disable the animal, or at least to cause sufficient bleeding to track the injured animal. A bullet in accordance with the preferred embodiments provides significantly greater damage when hunting with muzzle loaders.

One skilled in the art will appreciate that many variations are possible within the scope of the present invention. Thus, while the invention has been particularly shown and described with reference to preferred embodiments thereof, it will be understood by those skilled in the art that these and other changes in form and details may be made therein without departing from the spirit and scope of the invention.

I claim:

1. A projectile comprising:

a substantially rigid body portion that includes an axial cylindrical hole at a front of the body portion;

at least one deployable member that is in a retracted position within the body portion when the projectile is fired; and a nose piece having at least a portion within the axial cylindrical hole of the body portion, wherein the nose piece includes at least one shear member that comprises an annular ring portion of the nose piece that is outside of the axial cylindrical hole and is larger in diameter than the axial cylindrical hole, wherein the at least one shear member is sheared off when the nose piece contacts a target, thereby causing the nose piece to move inside of the body portion, thereby moving the at least one deployable member to a deployed position.

2. The projectile of claim 1 wherein the body portion comprises bronze.

3. The projectile of claim 1 wherein the nose piece comprises plastic.

4. The projectile of claim 1 wherein the at least one deployable member comprises hardened steel.

5. The projectile of claim 1 wherein the at least one deployable member comprises a plurality of knife members, each knife member having a sharp edge that is outside of the body portion when in the deployed position.

6. The projectile of claim 1 wherein the nose piece is friction-fit into the axial cylindrical hole in the body portion.

7. The projectile of claim 1 wherein the body portion comprises a portion of full diameter, and a portion of reduced diameter for receiving a sabot.

8. A projectile comprising:

a substantially rigid body portion, the body portion including an axial cylindrical hole at a front of the body portion, the body portion further including first and second slots on opposite sides of the body portion that extend from the axial cylindrical hole through the body portion;

a first deployable knife member that includes a first cutting edge that is in a retracted position inside the first slot when the projectile is fired;

a second deployable knife member that includes a second cutting edge that is in a retracted position inside the second slot when the projectile is fired;

a nose piece friction-fit into the axial cylindrical hole at the front of the body portion, wherein the nose piece includes at least one shear member that is sheared off when the nose piece contacts a target, thereby causing the nose piece to move inside of the body portion, thereby moving the first deployable knife member in a deployed position with the first cutting edge extending outside the first slot, and thereby moving the second deployable knife member in a deployed position with the second cutting edge extending outside the second slot; and a cylindrical groove in the body portion near the bottom of the axial cylindrical hole, wherein a first tab portion of the first deployable knife member extends into the cylindrical groove when the first deployable knife member is in the deployed position, and wherein a second tab portion of the second deployable knife member extends into the cylindrical groove when the second deployable knife member is in the deployed position.

9. The projectile of claim 8 wherein the first deployable knife member comprises a first raised member that has a height that makes a thickness of the first deployable knife member greater than a thickness of the first slot in the body portion, thereby retaining the first deployable knife member within the body portion until the nose piece forces the first raised member into the first slot when the first deployable knife member is moved into the deployed position when the projectile contacts the target.

10. The projectile of claim 9 wherein the first deployable knife member comprises a second raised member that has a height substantially greater than the first raised member, the second raised member holding a portion of the first deployable knife member inside the body portion when the first deployable knife member is in the deployed position outside of the first slot.

11. The projectile of claim 8 wherein the body portion comprises a portion of full diameter, and a portion of reduced diameter for receiving a sabot.

12. A projectile comprising:

a substantially rigid body portion, the body portion including an axial cylindrical hole at a front of the body portion, the body portion having a cylindrical groove near the bottom of the axial cylindrical hole, the body portion further including first and second slots on opposite sides of the body portion that are offset from each other by the width of one of the first and second slots;

a nose piece friction-fit into the axial cylindrical hole at the front of the body portion, wherein the nose piece includes at least one shear member that is sheared off when the nose piece contacts a target, thereby causing the nose piece to move inside of the body portion;

a first deployable knife member that includes a first cutting edge that is in a retracted position inside the first slot when the projectile is fired, wherein the first deployable knife member comprises a first raised member that has a height that makes a thickness of the first deployable knife member greater than a thickness of the first slot in the body portion, thereby retaining the first deployable knife member within the body portion until the projectile contacts a target, wherein the first deployable knife member comprises a second raised member that has a height substantially greater than the first raised member, the second raised member holding a portion of the first deployable knife member inside the body portion when the first deployable knife member is in the deployed position with the first cutting edge outside of the first slot, wherein a first tab portion of the first deployable knife member extends into the cylindrical groove when the first deployable knife member is in the deployed position, wherein movement of the nose piece inside the body portion causes the nose piece to push the first deployable knife member to the deployed position;

a second deployable knife member that includes a second cutting edge that is in a retracted position inside the second slot when the projectile is fired, wherein the second deployable knife member comprises a first raised member that has a height that makes a thickness of the second deployable knife member greater than a thickness of the second slot in the body portion, thereby retaining the second deployable knife member within the body portion until the projectile contacts a target, wherein the second deployable knife member comprises a second raised member that has a height substantially greater than the first raised member, the second raised member holding a portion of the second deployable knife member inside the body portion when the second deployable knife member is in the deployed position with the second cutting edge outside of the second slot, wherein a second tab portion of the second deployable knife member extends into the cylindrical groove when the second deployable knife member is in the deployed position, wherein movement of the nose piece inside the body portion causes the nose piece to push the second deployable knife member to the deployed position.

13. The projectile of claim 12 wherein the axial cylindrical hole in the body portion includes a v-shaped bottom, and wherein the first and second deployable knife members each comprise a v-shaped portion that lies in the v-shaped bottom when the first and second deployable knife members are in their deployed positions.

14. The projectile of claim 12 wherein the body portion comprises a portion of full diameter, and a portion of reduced diameter for receiving a sabot.

15. The projectile of claim 12 wherein the at least one shear member comprises an annular ring portion of the nose piece that is larger in diameter than the axial cylindrical hole.

16. A method for expanding the size of a projectile upon contact with a target, the method comprising the steps of:

(A) firing the projectile at the target, the projectile comprising:

a substantially rigid body portion that includes an axial cylindrical hole at a front of the body portion;

at least one deployable member that is in a retracted position within the body portion when the projectile is fired; and a nose piece having at least a portion within the axial cylindrical hole of the body portion, wherein the nose piece includes an annular ring portion that is outside of the axial cylindrical hole and is larger in diameter than the axial cylindrical hole;

(B) upon contacting the target, the force of the impact of the projectile on the target shearing off the annular ring portion of the nose piece to move the nose piece within the body portion, the movement of the nose piece within the body portion deploying the at least one deployable member to a deployed position.

17. The method of claim 16 wherein the deployment of the at least one deployable member causes the at least one deployable member to lock into place in the deployed position.

18. A projectile comprising:

a substantially rigid body portion, the body portion including an axial cylindrical hole at a front of the body portion, the body portion further including first and second slots on opposite sides of the body portion that extend from the axial cylindrical hole through the body portion;

a first deployable knife member that includes a first cutting edge that is in a retracted position inside the first slot when the projectile is fired;

a second deployable knife member that includes a second cutting edge that is in a retracted position inside the second slot when the projectile is fired; and a nose piece having at least a portion within the axial cylindrical hole of the body portion, wherein the nose piece includes an annular ring portion of the nose piece that is outside of the axial cylindrical hole and is larger in diameter than the axial cylindrical hole, wherein the annular ring portion is sheared off when the nose piece contacts a target, thereby causing the nose piece to move inside of the body portion, thereby moving the first deployable knife member in a deployed position with the first cutting edge extending outside the first slot, and thereby moving the second deployable knife member in a deployed position with the second cutting edge extending outside the second slot.

* * * * *